US006019480A

United States Patent [19]

Polkow

[11] Patent Number: 6,019,480

[45] Date of Patent: Feb. 1, 2000

[54] MARKER LIGHT ASSEMBLY

[75] Inventor: Jon C. Polkow, Monument, Colo.

[73] Assignee: Innovative Scuba Cocepts, Inc., Colorado Springs, Colo.

[21] Appl. No.: 09/057,955

[22] Filed: Apr. 9, 1998

[51] Int. Cl.[7] ..... F21V 33/00

[52] U.S. Cl. ..... 362/96; 362/23; 362/253; 362/29; 222/113

[58] Field of Search ..... 362/96, 253, 23, 362/29, 30; 222/113

[56] References Cited

U.S. PATENT DOCUMENTS

| | | | |
|---|---|---|---|
| 4,583,151 | 4/1986 | Nagel | 362/29 |
| 5,291,378 | 3/1994 | Stone | 362/96 |
| 5,491,617 | 2/1996 | Currie | 362/96 |
| 5,664,860 | 9/1997 | Berardi | 362/29 |

*Primary Examiner*—Thomas M. Sember
*Attorney, Agent, or Firm*—Richard W. Hanes

[57] ABSTRACT

A light emitting grip comprising, a manually operable rotatable knob mounted on a fastening shank projecting from a first side thereof and having a selectively switchable light source carried by the knob.

8 Claims, 3 Drawing Sheets

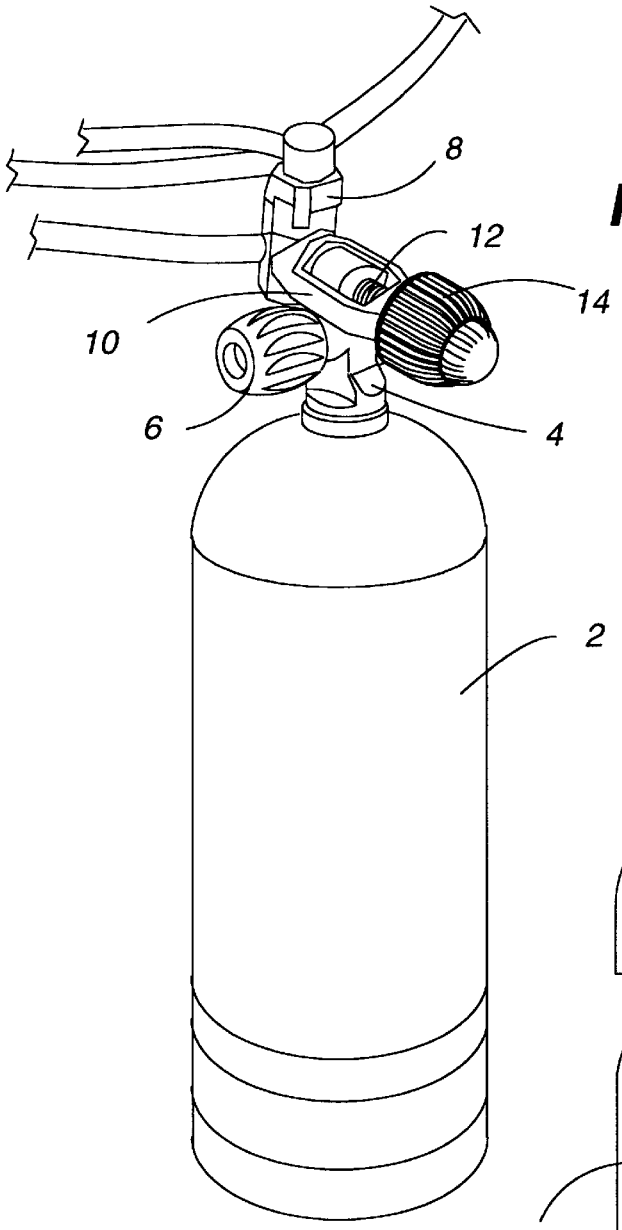
Fig. 1
Fig. 2
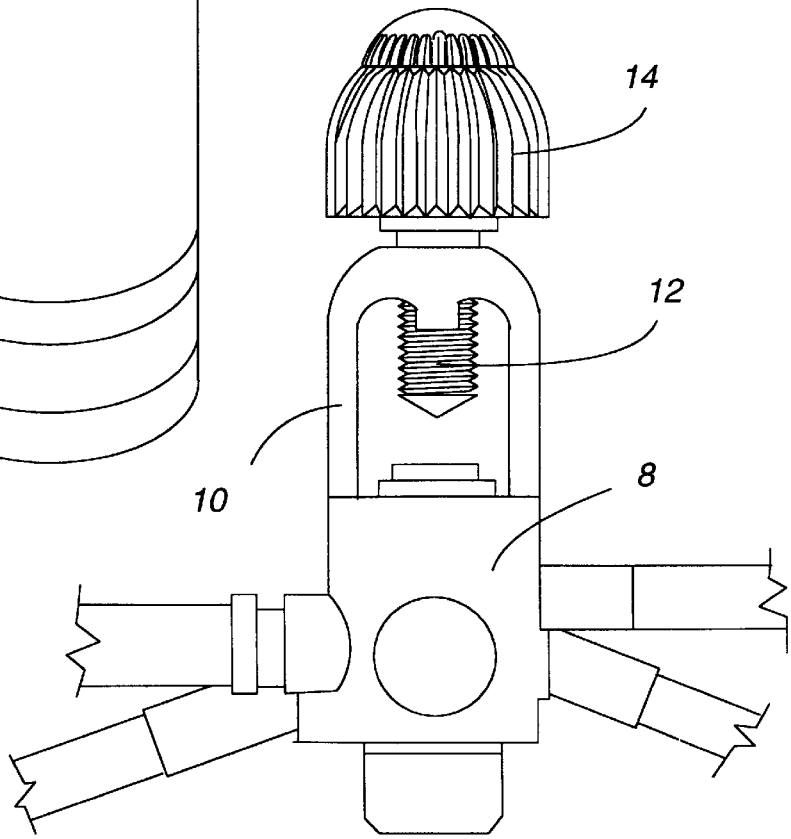

Fig. 3
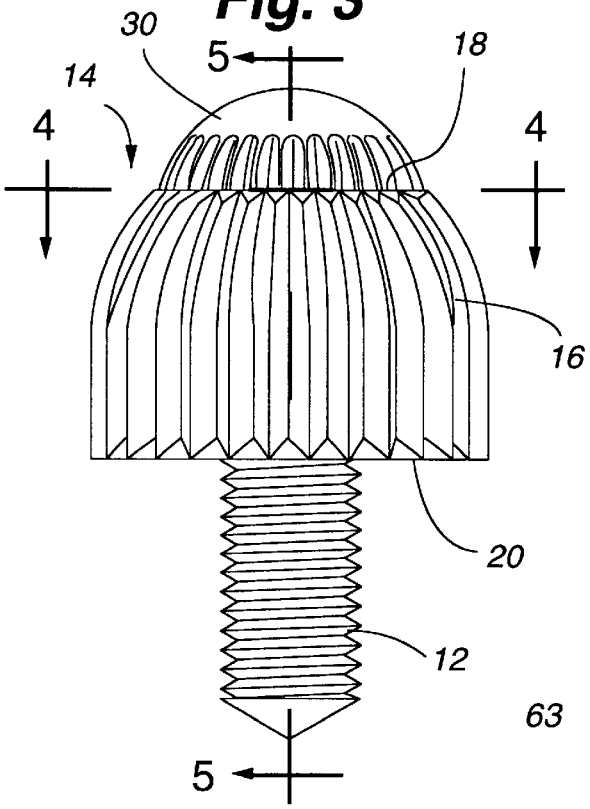
Fig. 8
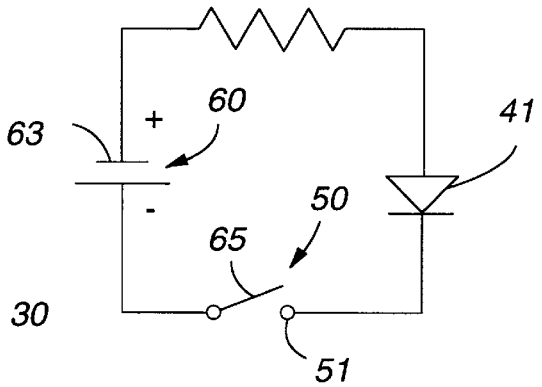
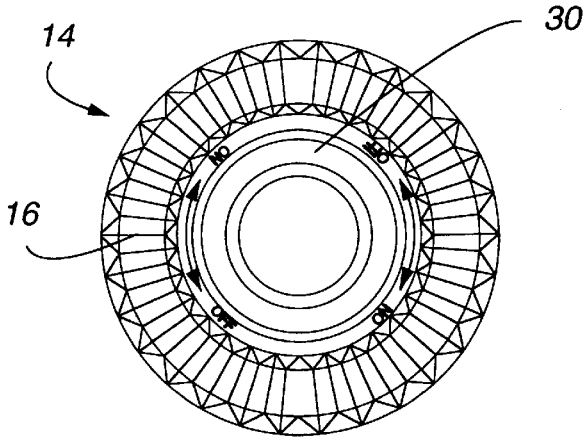
Fig. 4

MARKER LIGHT ASSEMBLY

The present invention relates to an assembly for mounting a marker light in an operative rotatable grip or knob.

BACKGROUND

Lights for marking routes, obstacles and hazards are well known in several different formats such as surmounting emergency vehicles, roadway barriers and defining theatre and aircraft isles, to mention only a few.

In addition to the foregoing, however, there is need for marking and identifying people and objects that frequently are or may be obscured, or partially so, by their immediate environment. Primary examples of people in the particular category include scuba divers that are diving or working together in water having poor visibility or at night. Firemen who are working in smoke filled areas constitute another class of individuals that would benefit from being able to quickly spot the location of other individuals in a working group by means of an easy to see marker light. Door knobs that are quickly perceptible in dark or smoke obscured areas would be a definite safety benefit. Scuba divers fireman and others that utilize air or oxygen breathing equipment all employ gas pressure regulators that perform with turning knobs and grips, similar in function to the operative knobs or handles on building doors.

Accordingly, it is the primary object of the present invention to provide a marker light assembly for rotatable knobs grips and handles in order for one to easily and quickly recognize the location of the person or thing carrying the knob or grip as part of their or its equipment or accouterment.

Another object of the invention is to provide a light source for rotatable operating grips, including the power source, the circuitry, the illuminating device and a switch, or other device, with which to turn the light on and off.

Other and further objects, features and advantages of the present invention will become apparent upon a reading of the following description of the preferred form of the invention, together with suggestions and descriptions of alternative embodiments.

DESCRIPTION OF THE DRAWINGS

FIG. 1 is a perspective view of a typical air tank to which is connected the first stage of the pressure regulator. Shown fragmentarily are the various hoses which lead from the first stage to various end devices, such as the second stage of one or more pressure regulators used for breathing, an air supply indicator and others.

FIG. 2 is a top plan view of the attachment yoke of the first stage regulator showing the air hoses fragmentarily and showing the yoke screw which attaches the regulator's first stage to the tank valve.

FIG. 3 is a side view of the yoke screw of the present invention, including the manually operable knob, or grip, that is used to turn the screw.

FIG. 4 is a top view of the knob of the yoke screw.

FIG. 8 is a typical circuit diagram of the lighting source, including the battery and the switch.

DESCRIPTION OF A PREFERRED EMBODIMENT

Figure 5:
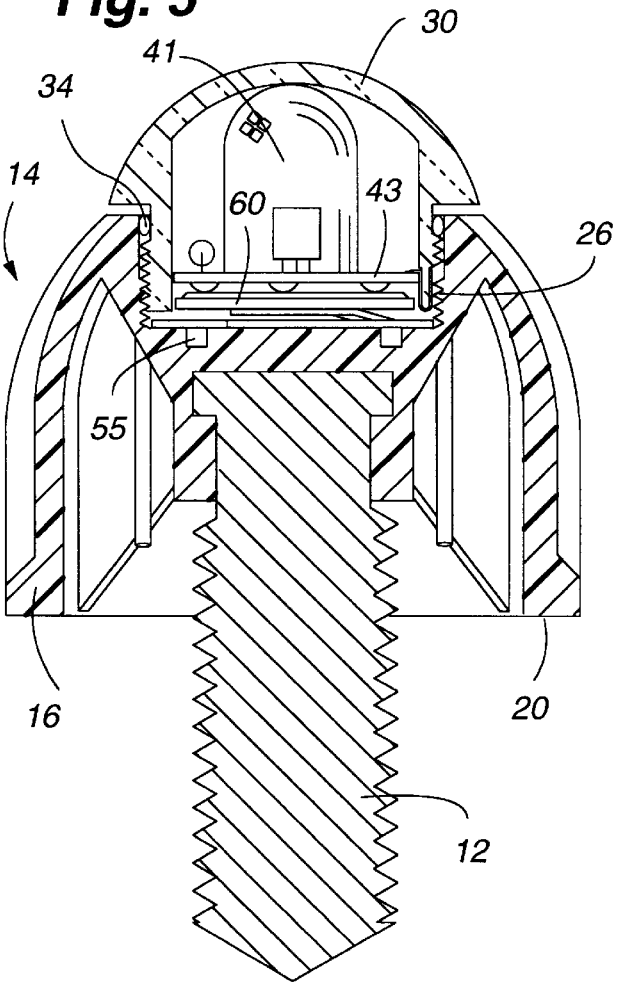
FIG. 5 is a cross sectional view taken along lines 5—5 of FIG. 3

Although the invention can take different forms, the preferred form of the invention is characterized as a yoke screw knob light (yoke light) on the first stage of an air regulator, such as those used by scuba divers.

Referring to FIGS. 1 and 2, a tank 2 for holding breathing air under pressure is shown. A valve 4, having a valve handle 6, projects from the top of the tank. The first stage 8 of the air pressure regulator is attached to the tank valve 4 with a yoke 10 that fastens the first stage to the valve's air outlet. The port for transferring the air from the valve outlet to the regulator first stage is a bore through the aft end of the yoke 10 (not shown). A threaded fastening shank 12 with a turning knob 14 is carried through the opposite end of the yoke. To attach the yoke to the valve the yoke screw 12 is turned with the knob 14 until the top of the valve 4 is held tightly between the end of the screw and the aft end of the yoke.

The yoke screw knob 14 serves as an advantageous location for a diver's marker light, to indicate the position of the diver to other divers. Such a light is especially useful during night diving operations or in water having limited visibility.

The yoke screw knob 14 is preferably made of plastic or metal. The knob comprises a body 16 of substantially hemispherical shape, although other convenient shapes for gripping and turning are also perfectly acceptable. The outer surface of the knob is knurled, ridged or shaped for easy gripping. The inside of the knob is constructed so as to anchor one end of the threaded shank screw 12. In the preferred form of the invention the body 16 of the knob is truncated, forming a flat plane section 18 that is parallel with the equatorial base 20 of the body. A central circular cavity 22 is recessed from the plane section 18, as shown best in FIG. 6. The cavity, or recess, 22 contains a flat bottom surface 24 and sidewalls 26 that are threaded.

A translucent dome shaped lens 30 having a depending circular neck 32 that is threaded on the distal end of its outside surface is sized and adapted to be screwed into the threaded sidewalls 26 of the recess 22 in the knob 14 so as to mount the lens over the recess on the plane surface of the truncated knob. An O-ring 34 surrounds the upper, or proximal, portion of the depending lens neck 32 to provide a water tight seal between the body of the knob and the lens neck keeping the interior of the cavity 22 free from water.

Figure 6:
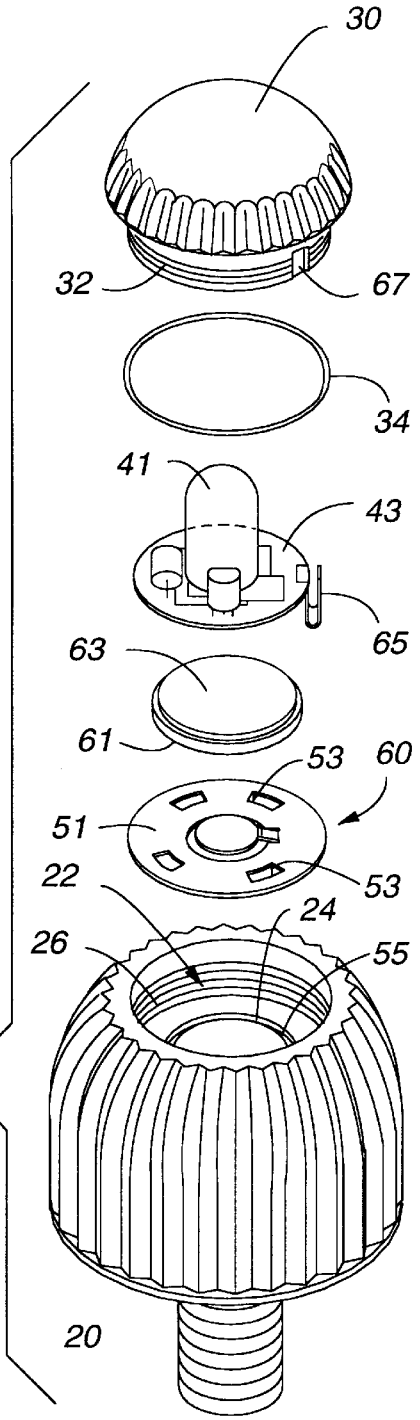
FIG. 6 is a perspective exploded view of the yoke screw knob of the present invention and the various components of the lighting source that is disposed in a recess in the top of the knob.

Mounted inside the recess 22 is a light source. Generally, the lighting source comprises a power source electrical circuitry, an illumination device and a switch for turning the light on or off. As seen in FIGS. 5 and 6, illumination is provided by a light emitting diode (LED) 41 that is secured to the top side of a circular printed circuit board 43. Several different configurations of electrical circuits that interconnect the components of the light source are possible depending upon the desired end result. For example, the LED can be made to flash intermittently or flash a code, such as SOS, when it is turned on. Alternatively, it can be made to stay illuminated constantly until it is turned off. The circuitry to accomplish either of these ends is well known and does not form a part of this invention except for the construction of the switch and its method of operation as will be now explained.

The first contact of the switch 50 comprises a circular metal plate 51 that is seated on the bottom of the recess 22.

In order to at least partially secure the plate into the recess, the plate is provided with a plurality of punched out ears 53 that are press fitted into a circular channel 55 in the bottom of the recess. A coin cell type of battery 60, having the top and bottom surfaces thereof 61 and 63 as its respective terminals, rests flat against the upper surface of the circular plate 51 making electrical contact therewith. The battery is of smaller diameter than the plate 51, leaving an annular outer ring portion of the upper plate surface uncovered by the battery 60.

The upper terminal surface 63 of the battery 60 faces the underside of the printed circuit board when the components are assembled. Therefore when the circuit board is depressed downwardly by the screwing down of the lens 30, one or more electrical contacts on the underside of the circuit board will contact the terminal surface 63 of the battery, thus bring the electrical power source into the circuit.

Figure 7:
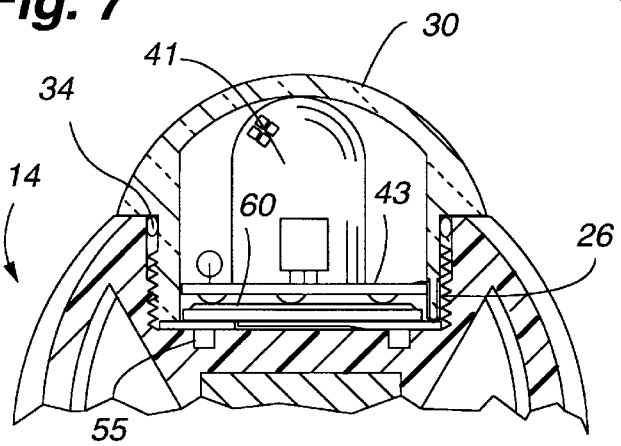
FIG. 7 is a cross sectional view of the manually operable knob.

The circular shaped circuit board 43 is press fitted into the inside of the neck 32 of the lens 30. In addition to the support provided by the press fit, the circuit board is provided with a depending springable metal finger 65, one end of which is mechanically connected to the board 43. The other end of the finger is bent over into a hook configuration so as to be capable of mechanical connection to the neck of the lens. The finger 65 is also electrically connected into the circuitry on the circuit board, as shown in FIG. 7. The hook acts in two capacities. It first serves as a mechanical connection to assist in securing the circuit board to the neck 32 of the lens. It does so by the bent over end hooking over the bottom edge of the neck and tucking into a small longitudinal channel 67 recessed below the level of the threads on the exterior surface of the neck. By the hook's disposition in the recessed channel, it does not interfere with the smooth engagement between the neck threads and the threads of the cavity sidewalls 26 when the lens is being screwed into the cavity. The second function performed by the metal finger 65 is to act as the second contact of the switch 50 that turns the illuminating source 41 on and off. The end of the bent finger 65 that snaps over the bottom edge of the lens neck is positioned to come into contact with the exposed annular outer ring of the plate 51 when the lens neck travels downwardly by the manual act of screwing the lens 30 into the cavity 22. Such contact effectuates a closure of the switch 50, which enables the circuit and turns on the LED, either as a constant source of light, or as an intermittent light, depending on the make-up of the circuit. By unscrewing the lens a small amount, the lens and the attached hook are elevated away from contact with the switch plate 51 and the circuit is broken or disabled, turning off the LED.

After the lens is substantially seated within the cavity, further rotation of the lens in its threaded engagement with the sidewalls of the cavity will cause the finger 65 to make contact with the switch plate 51, as previously described. However, in making such contact the battery is sandwiched between the bottom contacts of the circuit board 43 and the switch plate 51. The operation of the switch formed by the finger 65 and the plate 51 presents a better feel to the operator of the lens if the sandwich is somewhat compressible. To implement this feature the center of the switch plate 43 is cut out in an annular pattern that is not a complete circle but leaves a small tab 57 that interconnects the body of the plate to the center section 59 of the switch plate. By slightly permanently deforming the center section 59 upwardly above the level of the rest of the plate before the battery is placed on the plate, a springable support for the battery is formed. As the battery is depressed by the turning of the lens and the consequent downward pressure of the circuit board against the top surface 63 of the battery, the supporting center section 59 of the plate 51 moves the tab 57 elastically downwardly providing a spring bias upwardly against the battery. When the pressure on the battery is released by turning the lens in the opposite direction from that of seating the battery downwardly the center section elastically raises.

While an LED and an associated circuit have been described, different kinds of light sources can be utilized, such as incandescent or fluorescent lights. It is also within the scope of the invention to utilize chemical lights disposed within the recess of the knob or mounted elsewhere on the knob or grip, subject only to access to initiate the light producing chemical reaction.

I claim:

1. A marker light assembly for a breathing-gas holding tank comprising, a tank for holding breathing gas, a gas pressure regulator, means for interconnecting the tank and the gas pressure regulator, including, a fastening screw operatively connected to the interconnecting means, a turning knob attached to the screw, and a light source carried by the turning knob.

2. The assembly of claim 1 wherein the turning knob includes therein a recess having a bottom surface and sidewalls and wherein at least a portion of the light source is disposed in the recess.

3. The combination of claim 2 and further including, a translucent lens carried by the turning knob and covering at least a portion of the recess.

4. The combination of claim 3 wherein the sidewalls of the recess are at least partially threaded and the lens includes, a threaded neck that is adapted for engagement with the threads of the sidewalls of the recess, and where the light source further includes, a power source, illuminating means having a plurality of electrical contacts switch means having first and second contacts and selectively interconnecting the power source and the illuminating means, where said first contact of said switch means is carried by the neck of the lens.

5. The combination of claim 4 where the light source includes, an electrically conductive plate disposed on the bottom surface of the recess comprising the second contact of the switch means, a battery having first and second terminals, wherein the first terminal is positioned and adapted for electrical contact with the plate and the second terminal is positioned and adapted for electrical contact with one of the contacts of the illuminating means.

6. The combination of claim 5 wherein the plate includes, an elastically depressible center portion to accommodate vertical movement of the battery in response to vertical movement of the lens as a function of rotation of the lens while in threaded engagement with the side walls of the recess.

7. The assembly of claim 1 where the turning knob comprises, a truncated hemispherical gripping body having an equatorial base and a plane section parallel to the base, a circular cavity recessed from the plane section and having a bottom surface and threaded side walls, a translucent lens having a circular depending threaded neck sized and adapted for threading engagement with the threaded side walls of the cavity to interconnect the lens and the gripping body and to operatively raise and lower the lens with respect to the plane section, where the light source is disposed within the confines of the cavity and the lens.

8. The combination of claim 7 and further including, switch means for turning the light source on or off responsive to the respective lowered or raised position of the lens with respect to the plane section.

* * * * *